US006468046B1

(12) United States Patent
Du et al.

(10) Patent No.: US 6,468,046 B1
(45) Date of Patent: Oct. 22, 2002

(54) APPARATUS AND METHOD FOR CONTROLLING A DISCHARGE PRESSURE OF A VARIABLE DISPLACEMENT HYDRAULIC PUMP

(75) Inventors: Hongliu Du, Dunlap, IL (US); Noah D. Manring, Columbia, MO (US)

(73) Assignee: Caterpillar Inc, Peoria, IL (US)

( * ) Notice: Subject to any disclaimer, the term of this patent is extended or adjusted under 35 U.S.C. 154(b) by 0 days.

(21) Appl. No.: 09/665,242

(22) Filed: Sep. 18, 2000

(51) Int. Cl.[7] ..... F04B 1/26
(52) U.S. Cl. ..... 417/222.1
(58) Field of Search ..... 417/222.1, 222.2, 417/218, 212; 700/42; 318/610; 91/502, 505, 504, 506, 507

(56) References Cited

U.S. PATENT DOCUMENTS 3,647,321 A * 3/1972 Boydell ..... 417/222.1
3,738,779 A 6/1973 Hein et al.
3,797,245 A 3/1974 Hein
3,945,764 A 3/1976 Marietta
4,028,010 A 6/1977 Hopkins
4,097,196 A 6/1978 Habiger
4,212,596 A 7/1980 Fuseff
4,553,904 A 11/1985 Ruseff et al.
5,173,224 A * 12/1992 Nakamura et al. ..... 264/40.6
5,222,870 A 6/1993 Budzich
5,297,941 A * 3/1994 Park ..... 417/218
5,325,288 A * 6/1994 Satou ..... 364/162
5,331,541 A * 7/1994 Ueda et al. ..... 364/162
5,384,526 A * 1/1995 Bennett ..... 318/610
5,503,534 A * 4/1996 Rhody ..... 417/218
5,507,266 A * 4/1996 Wright et al. ..... 123/497
5,525,043 A * 6/1996 Lukich ..... 417/218
5,567,123 A * 10/1996 CHildress et al. ..... 417/222
5,588,805 A * 12/1996 Geringer ..... 417/53
5,697,764 A 12/1997 Oda et al.
5,798,941 A * 8/1998 McLeister ..... 364/141
5,881,629 A * 3/1999 Gollner et al. ..... 91/505
5,947,695 A * 9/1999 Nagaoka et al. ..... 417/213
6,033,188 A * 3/2000 Baldus et al. ..... 417/222.1
6,068,451 A * 5/2000 Uppal ..... 417/222.1
6,135,724 A * 10/2000 Yoder et al. ..... 417/286
6,302,653 B1 * 10/2001 Bryant et al. ..... 417/53

* cited by examiner

*Primary Examiner*—Teresa Walberg
*Assistant Examiner*—Daniel Robinson
(74) *Attorney, Agent, or Firm*—Steve D Lundquist

(57) ABSTRACT

An apparatus and method for controlling a discharge pressure of a variable displacement hydraulic pump. The apparatus and method includes a swashplate pivotally attached to the pump, a control servo operable to increase an angle of the swashplate relative to the pump, a biasing servo operable to decrease the angle of the swashplate relative to the pump, a servo valve having an output port hydraulically connected to the control servo, a divertor line having a first end connected to the pump output port and a second end connected to the biasing servo, and means for controlling the servo valve as a function of the discharge pressure of the pump.

13 Claims, 4 Drawing Sheets

APPARATUS AND METHOD FOR CONTROLLING A DISCHARGE PRESSURE OF A VARIABLE DISPLACEMENT HYDRAULIC PUMP

TECHNICAL FIELD

This invention relates generally to an apparatus and method for controlling a variable displacement hydraulic pump and, more particularly, to an apparatus and method for controlling variations in pump discharge pressure caused by load variations.

BACKGROUND ART

Variable displacement hydraulic pumps, such as axial piston variable displacement pumps, are widely used in hydraulic systems to provide pressurized hydraulic fluid for various applications. For example, hydraulic earthworking and construction machines, e.g., excavators, dozers, loaders, and the like, rely heavily on hydraulic systems to operate, and hence often use variable displacement hydraulic pumps to provide the needed pressurized fluid.

These pumps are driven by a constant speed mechanical shaft, for example by an engine, and the discharge flow rate, and hence pressure, is regulated by controlling the angle of a swashplate pivotally mounted to the pump.

Ideally, it is desired to maintain a desired output pressure, i.e., the pump discharge pressure, for a given swashplate angle. However, variations in loading on the hydraulic system may require the pump discharge pressure to be varied as well, which in turn requires changes to be made to the angle of the swashplate. These changes, in conventional pump control systems, often result in overshoot, i.e., pressure spikes. Thus, relief valves must be used to prevent these pressure spikes from damaging the pump or hydraulic system.

In many conventional design pump systems, the pump discharge pressure is fed back to a biasing servo, which is configured to increase the swashplate angle as the pump discharge pressure increases. The increased swashplate angle further increases the pump discharge pressure, thus leading to an unstable open loop condition of the pump.

It is desired to develop a control system for a variable displacement pump which utilizes the benefits and simplicity of a linear first order dynamic system which eliminates overshoot, thus eliminating the need for relief valves. To accomplish this, it is also desired to configure the variable displacement pump so that the open loop system is internally stable.

The present invention is directed to overcoming one or more of the problems as set forth above.

DISCLOSURE OF THE INVENTION

In one aspect of the present invention an apparatus for controlling a discharge pressure of a variable displacement hydraulic pump is disclosed. The apparatus includes a swashplate pivotally attached to the pump, a control servo operable to increase an angle of the swashplate relative to the pump, a biasing servo operable to decrease the angle of the swashplate relative to the pump, a servo valve having an output port hydraulically connected to the control servo, a divertor line having a first end connected to the pump output port and a second end connected to the biasing servo, and means for controlling the servo valve as a function of the discharge pressure of the pump.

In another aspect of the present invention a method for controlling a discharge pressure of a variable displacement hydraulic pump is disclosed. The method includes the steps of sensing a level of the discharge pressure at the pump output port, and diverting a portion of the pump discharge pressure to a biasing servo, the biasing servo being operable to decrease an angle of a swashplate relative to the pump, the swashplate being pivotally attached to the pump. The method also includes the steps of delivering a control signal to a servo valve as a function of the sensed level of discharge pressure, and delivering a responsive hydraulic control flow from the servo valve to a control servo, the control servo being operable to increase the angle of the swashplate.

BEST MODE FOR CARRYING OUT THE INVENTION

Figure 1:
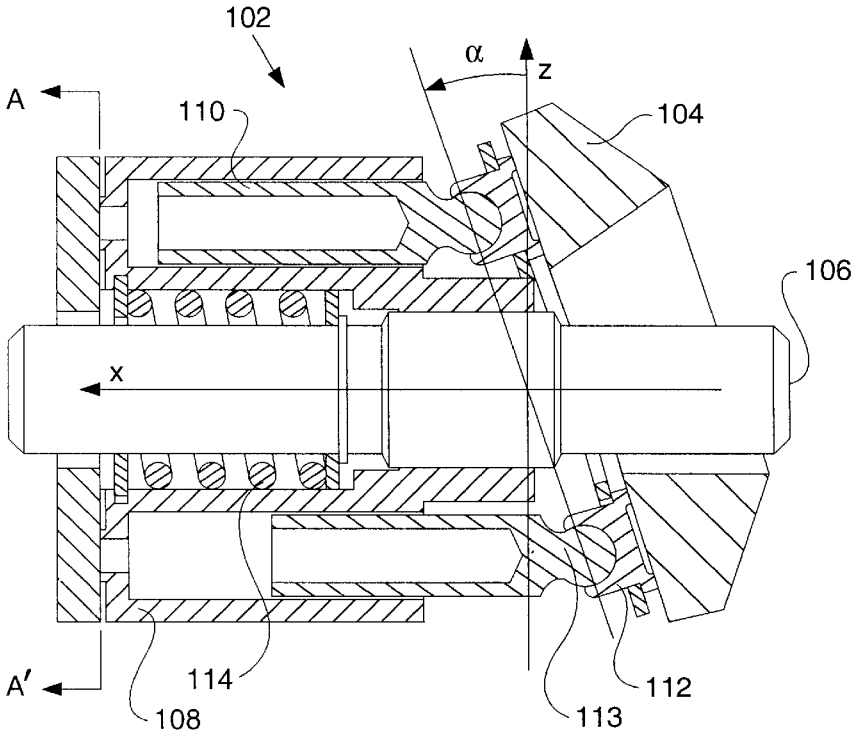
FIG. 1 is a diagrammatic side profile cutaway view of a variable displacement hydraulic pump suitable for use with the present invention.

Referring to the drawings, an apparatus 100 and method for controlling a discharge pressure of a variable displacement hydraulic pump 102 is disclosed.

Figure 2:
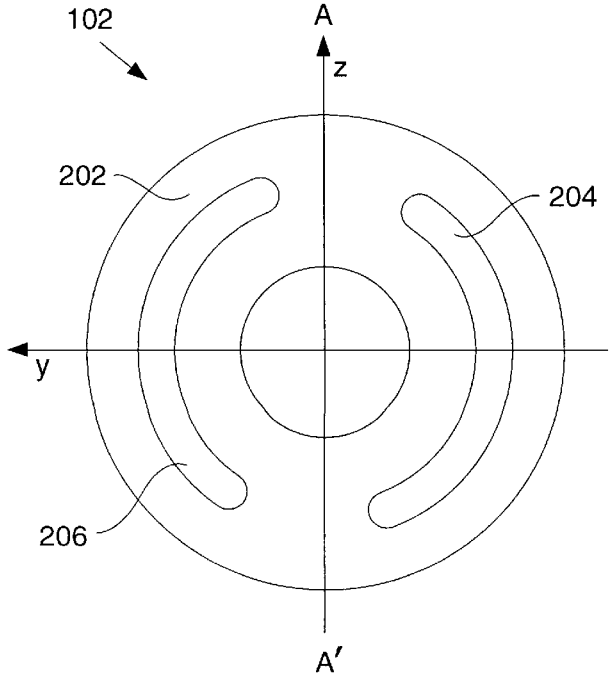
FIG. 2 is a diagrammatic end view of the pump of FIG. 1.

With particular reference to FIGS. 1 and 2, the variable displacement hydraulic pump 102, hereinafter referred to as pump 102, is preferably an axial piston swashplate hydraulic pump 102 having a plurality of pistons 110, e.g., nine, located in a circular array within a cylinder block 108. Preferably, the pistons 110 are spaced at equal intervals about a shaft 106, located at a longitudinal center axis of the block 108. The cylinder block 108 is compressed tightly against a valve plate 202 by means of a cylinder block spring 114. The valve plate includes an intake port 204 and a discharge port 206.

Each piston 110 is connected to a slipper 112, preferably by means of a ball and socket joint 113. Each slipper 112 is maintained in contact with a swashplate 104. The swashplate 104 is inclinably mounted to the pump 102, the angle of inclination $\alpha$ being controllably adjustable.

Figure 3:
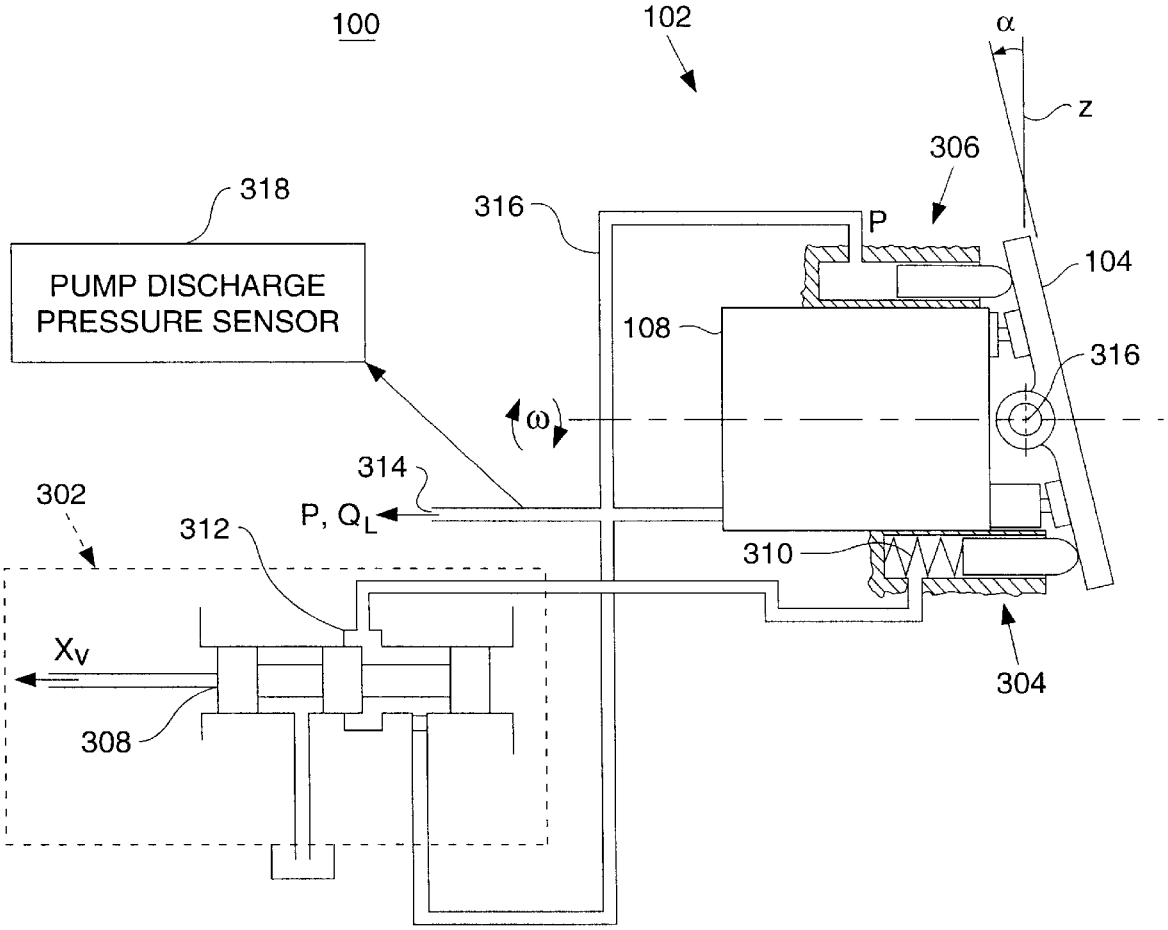
FIG. 3 is a diagrammatic illustration of a pump including a servo valve.

With continued reference to FIGS. 1 and 2, and with reference to FIG. 3, operation of the pump 102 is illustrated. The cylinder block 108 rotates at a constant angular velocity $\omega$. As a result, each piston 110 periodically passes over each of the intake and discharge ports 204, 206 of the valve plate 202. The angle of inclination $\alpha$ of the swashplate 104 causes the pistons 110 to undergo an oscillatory displacement in and out of the cylinder block 108, thus drawing hydraulic fluid into the intake port 204, which is a low pressure port, and out of the discharge port 206, which is a high pressure port.

In the preferred embodiment, the angle of inclination $\alpha$ of the swashplate 104 inclines about a swashplate pivot point 316 and is controlled by a servo valve 302. A servo valve spool 308 is controllably moved in position within the servo valve 302 to control hydraulic fluid flow at an output port 314 of the servo valve 302. In the preferred embodiment, the servo valve 302 is an electro-hydraulic valve, and is thus controlled by an electrical signal being delivered to the valve 302.

A control servo 304, in cooperation with a servo spring 310, receives pressurized fluid from the output port 312 of the servo valve 302, and responsively operates to increase the angle of inclination $\alpha$ of the swashplate 104, thus increasing the stroke of the pump 102. The pump 102 provides pressurized hydraulic fluid to the discharge port 206 of the valve plate 202 by means of a pump output port 314. A biasing servo 306 receives pressurized fluid from the output port 314 of the pump 102 via a divertor line 316, and responsively operates to decrease the angle of inclination $\alpha$ of the swashplate 104, thus decreasing the stroke of the pump 102. Preferably, the control servo 304 is larger in size and capacity than the biasing servo 306.

A pump discharge pressure sensor 318, preferably located at the pump output port 314, is adapted to sense the output pressure of the hydraulic fluid from the pump 102. Alternatively, the pump output pressure sensor 318 may be located at any position suitable for sensing the pressure of the fluid from the pump 102, such as at the discharge port 206 of the valve plate 202, at a point along the hydraulic fluid line from the pump 102 to the hydraulic system being supplied with pressurized fluid, and the like. In the preferred embodiment, the pump discharge pressure sensor 318 is of a type well known in the art and suited for sensing pressure of hydraulic fluid.

In the configuration of FIG. 3, if high frequency components, such as valve dynamics and the like, are neglected, the pump discharge pressure P may be expressed as an open loop transfer function as:

$$P(s) = \frac{-(q_1 s + q_0)Q_L(s) + v_0 x_v(s)}{p_2 s^2 + p_1 s + p_0} \qquad \text{(Eq. 1)}$$

where $Q_L(s)$ is the discharge flow rate of the pump 102, $x_v(s)$ is the position of the servo valve spool 308 in the servo valve 302, $v_0$ is a valve gain coefficient of the servo valve 302, $q_1$ and $q_0$ are flow disturbance dynamics coefficients, and $P_2$, $P_1$, and $P_0$ are positive constants derived from various design parameters of the pump 102, control servo 304, biasing servo 306, servo valve 302, and the like.

It has been found that the open loop transfer function of Eq. 1 is a stable system due to the positive values of $P_2$, $P_1$, and $P_0$. These positive values are attained by the configuration of FIG. 3.

Figure 4:
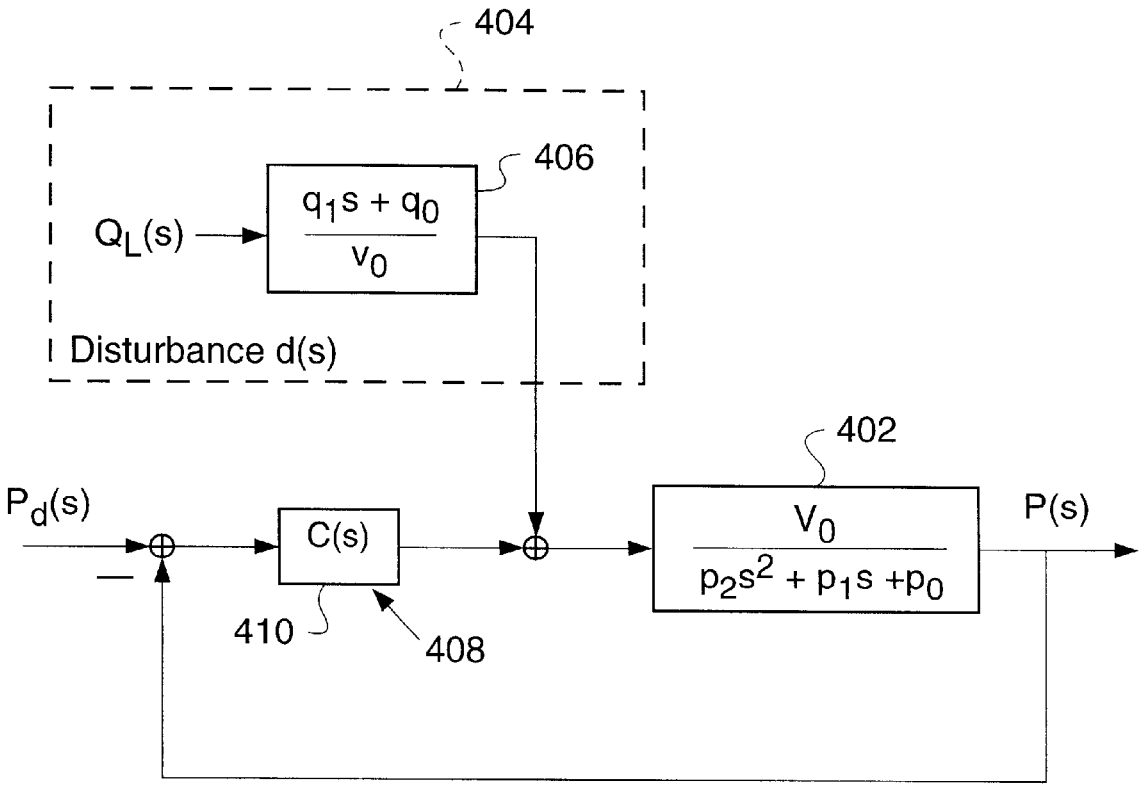
FIG. 4 is a control diagram illustrating a preferred embodiment of the present invention.

Referring to FIG. 4, a control diagram illustrating a preferred embodiment of the present invention is shown. The control diagram provides a closed loop system based on the inherently stable open loop system of FIG. 3. The open loop system portion of FIG. 4 is shown by an open loop transfer function 402 and a disturbance function 404. The disturbance function 404 includes flow disturbance dynamics 406, which result from variations in the flow rate of the hydraulic fluid during normal operation.

A means 408 for controlling the servo valve 302 as a function of the pump discharge pressure P preferably includes a controller 410 adapted to control an electrical signal applied to the servo valve 302. In the preferred embodiment, the controller 410 is a PID controller expressed as:

$$C(s) = \frac{\omega_c}{v_0}\left(p_2 s + p_1 + \frac{p_0}{s}\right) \qquad \text{(Eq. 2)}$$

where $\omega_c$ is a closed-loop cutoff frequency chosen based on factors such as the response time of the servo valve 302 and the like. Generally, it is desired to choose a value of $\omega_c$ that is fairly large to increase the performance of the system. However, the value of $\omega_c$ is limited by the bandwidth of the servo valve 302 and various system uncertainties, such as inertia of the swashplate 104 and compressibility of the hydraulic fluid.

From Eq. 2, the PID gain components may be expressed as:

$$k_p = \frac{-p_1\omega_c}{v_0}, \quad k_i = \frac{-p_0\omega_c}{v_0}, \quad \text{and} \quad k_d = \frac{-p_2\omega_c}{v_0} \qquad \text{(Eqs. 3, 4, and 5)}$$

Figure 5:
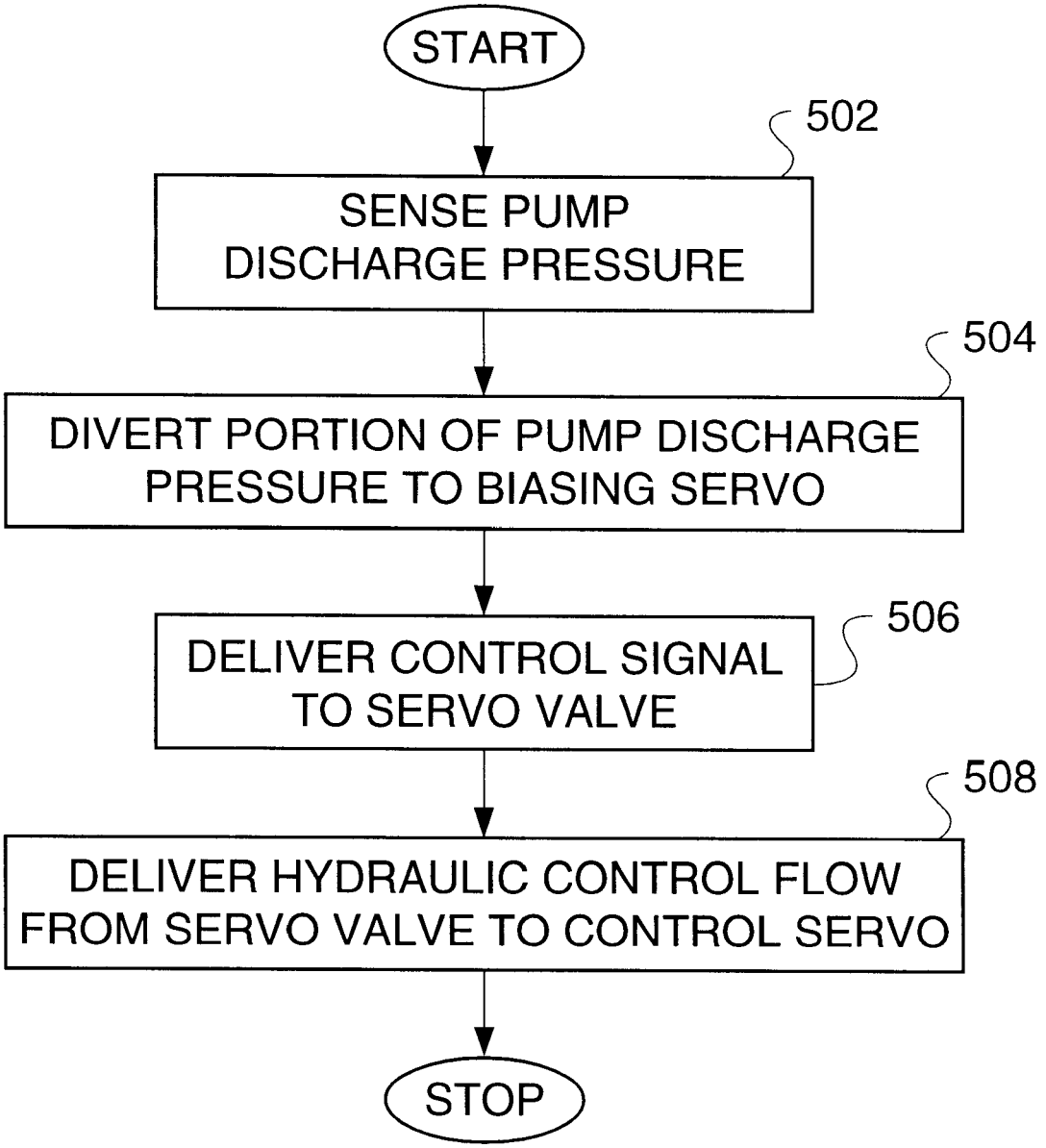
FIG. 5 is a flow diagram illustrating a preferred method of the present invention.

Referring to FIG. 5, a flow diagram illustrating a preferred method of the present invention is shown.

In a first control block 502, the level of the pump discharge pressure P at the pump output port 314 is sensed. Preferably, the pump discharge pressure is sensed by means of a pump discharge pressure sensor 318, as described above.

In a second control block 504, a portion of the pump discharge pressure is diverted, by means of the divertor line 316, to the biasing servo 306. The biasing servo 306, in the preferred embodiment, is operable to decrease the angle of inclination $\alpha$ of the swashplate 104.

In a third control block 506, a control signal is delivered to the servo valve 302 as a function of the sensed level of pump discharge pressure. Preferably, the control signal is controlled and delivered by the PID controller 410, as described above.

In a fourth control block 508, the servo valve 302 delivers a hydraulic control flow to the control servo 304 in response to the received control signal. In the preferred embodiment, as described above, the control servo 304 is operable to increase the angle of inclination $\alpha$ of the swashplate 104.

INDUSTRIAL APPLICABILITY

The present invention provides a pressure control method in cooperation with a non-conventional control actuation configuration for variable displacement hydraulic pumps. The control method results in a stable first order, closed loop system. Based on the system of the present invention, the pump discharge pressure P will track the desired pump discharge pressure $P_d$ without typical overshoot of the controlled pressure. Therefore, relief valves currently used with variable displacement pumps are no longer needed.

Other aspects, objects, and features of the present invention can be obtained from a study of the drawings, the disclosure, and the appended claims.

What is claimed is:

1. An apparatus for controlling a discharge pressure of a variable displacement hydraulic pump, the discharge pressure being located at a pump output port, comprising:

a swashplate pivotally attached to the pump;

a control servo operable to increase an angle of the swashplate relative to the pump;

a biasing servo operable to decrease the angle of the swashplate relative to the pump;

a servo valve having an output port hydraulically connected to the control servo;

a divertor line having a first end connected to the pump output port and a second end connected to the biasing servo; and means for controlling the servo valve as a function of the discharge pressure of the pump.

2. An apparatus, as set forth in claim 1, wherein the control servo includes a servo spring to maintain a spring force on the swashplate.

3. An apparatus, as set forth in claim 2, wherein the servo valve is adapted to provide hydraulic pressure to the control servo, and the control servo is responsively adapted to provide a force operable to increase the angle of the swashplate.

4. An apparatus, as set forth in claim 1, wherein the divertor line is adapted to provide hydraulic pump discharge pressure to the biasing servo, and the biasing servo is responsively adapted to provide a force operable to decrease the angle of the swashplate.

5. An apparatus, as set forth in claim 1, wherein the control servo has a diameter larger than the diameter of the biasing servo.

6. An apparatus, as set forth in claim 1, wherein the swashplate is adapted to increase the pump discharge pressure in response to an increase in the angle of the swashplate relative to the pump, and to decrease the pump discharge pressure in response to a decrease in the angle of the swashplate.

7. An apparatus, as set forth in claim 1, wherein the servo valve is an electro-hydraulic servo valve.

8. An apparatus, as set forth in claim 7, wherein the means for controlling the servo valve includes a controller adapted to control an electrical signal applied to the servo valve.

9. An apparatus, as set forth in claim 8, wherein the controller is a PID controller.

10. A method for controlling a discharge pressure of a variable displacement hydraulic pump, the discharge pressure being located at a pump output port, including the steps of:

sensing a level of the discharge pressure at the pump output port;

diverting a portion of the pump discharge pressure to a biasing servo, the biasing servo being operable to decrease an angle of a swashplate relative to the pump, the swashplate being pivotally attached to the pump;

delivering a control signal to a servo valve as a function of the sensed level of discharge pressure; and delivering a responsive hydraulic control flow from the servo valve to a control servo, the control servo being operable to increase the angle of the swashplate.

11. A method, as set forth in claim 10, wherein the servo valve is an electro-hydraulic servo valve, and wherein delivering a control signal to the servo valve includes the step of delivering an electrical control signal to the servo valve.

12. A method, as set forth in claim 11, wherein delivering a control signal includes the step of determining the control signal by a PID controller.

13. An apparatus for controlling a discharge pressure of a variable displacement hydraulic pump, the discharge pressure being located at a pump output port, comprising:

means for sensing a level of the discharge pressure at the pump output port;

means for diverting a portion of the pump discharge pressure to a biasing servo, the biasing servo being operable to decrease an angle of a swashplate relative to the pump, the swashplate being pivotally attached to the pump;

means for delivering a control signal to a servo valve as a function of the sensed level of discharge pressure; and means for delivering a responsive hydraulic control flow from the servo valve to a control servo, the control servo being operable to increase the angle of the swashplate.

* * * * *